US008750778B2

(12) United States Patent
Maeda

(10) Patent No.: US 8,750,778 B2
(45) Date of Patent: Jun. 10, 2014

(54) LASER FUSING APPARATUS AND IMAGE FORMING APPARATUS PROVIDED WITH THE SAME

(75) Inventor: Tomohiro Maeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 303 days.

(21) Appl. No.: 13/197,496

(22) Filed: Aug. 3, 2011

(65) Prior Publication Data

US 2012/0045238 A1 Feb. 23, 2012

(30) Foreign Application Priority Data

Aug. 19, 2010 (JP) ..... 2010-184287

(51) Int. Cl.
*G03G 15/20* (2006.01)

(52) U.S. Cl.
USPC ..... 399/337; 399/336

(58) Field of Classification Search
USPC ..... 399/335, 336, 337, 67, 329
See application file for complete search history.

(56) References Cited

U.S. PATENT DOCUMENTS

| | | | | |
|---|---|---|---|---|
| 5,835,830 | A * | 11/1998 | Fukuda et al. | 399/307 |
| 6,577,836 | B2 * | 6/2003 | Yamashita et al. | 399/307 |
| 8,010,006 | B2 * | 8/2011 | Matsubara et al. | 399/67 |
| 8,260,185 | B2 * | 9/2012 | Matsubara et al. | 399/336 |
| 8,285,186 | B2 * | 10/2012 | Matsubara et al. | 399/336 |
| 8,306,468 | B2 * | 11/2012 | Matsubara et al. | 399/335 |
| 8,335,447 | B2 * | 12/2012 | Maeda | 399/336 X |
| 8,412,085 | B2 * | 4/2013 | Kodera et al. | 399/335 |
| 8,483,604 | B2 * | 7/2013 | Egusa et al. | 399/336 |
| 2008/0190657 | A1 | 8/2008 | Kanetaka et al. | |
| 2009/0245896 | A1 * | 10/2009 | Ishikake et al. | 399/336 X |

FOREIGN PATENT DOCUMENTS

| | | | |
|---|---|---|---|
| JP | 7-191560 | A | 7/1995 |
| JP | 7-332881 | A | 12/1995 |
| JP | 9-50201 | A | 2/1997 |
| JP | 11-38802 | A | 2/1999 |
| JP | 2002-23559 | A | 1/2002 |
| JP | 2004-20824 | A | 1/2004 |
| JP | 2008-89828 | A | 4/2008 |

* cited by examiner

*Primary Examiner* — Sandra Brase
(74) *Attorney, Agent, or Firm* — Birch, Stewart, Kolasch & Birch, LLP

(57) ABSTRACT

A laser fusing apparatus including: a laser light source for emitting a laser beam; a conveyance belt for conveying a sheet with a toner image being transferred thereon and guiding the sheet to an irradiation region in which the toner image is to be irradiated with the laser light source; a heat pipe including a heat receiving portion to receive heat generated by the laser light source and a heat releasing portion to supply the received heat to the conveyance belt; and a fuser control section for controlling the laser light source so that the laser light source irradiates the laser beam to the toner image when the toner image passes the irradiation region, thereby fixing the toner image onto the sheet, wherein the conveyance belt heats the sheet and the toner image with the heat supplied from the heat radiation section.

10 Claims, 11 Drawing Sheets

Transition of toner temperature when initial temperature of recording sheet conveyance belt is 30°C Transition of toner temperature when initial temperature of recording sheet conveyance belt is 40°C Transition of toner temperature when initial temperature of recording sheet conveyance belt is 50°C

LASER FUSING APPARATUS AND IMAGE FORMING APPARATUS PROVIDED WITH THE SAME

CROSS-REFERENCE TO RELATED APPLICATION

This application is related to Japanese Patent Application No. 2010-184287 filed on Aug. 19, 2010, whose priority is claimed and the disclosure of which is incorporated by reference in its entirety.

BACKGROUND OF THE INVENTION

1. Field of the Invention

The present invention relates to an image forming apparatus of an electrophotographic system, such as a copying machine, a printer, or a facsimile device, and more particularly to a laser fusing apparatus that fixes a non-fused image formed on a sheet by a laser beam irradiating unit, and an image forming apparatus provided with the same.

2. Description of the Related Art

An image forming apparatus of an electrophotographic system such as a printer has a fusing apparatus that fixes a toner image, which is formed onto a sheet-like printing medium (hereinafter merely referred to as a sheet, wherein a representative embodiment is a printing sheet) onto a sheet by a thermal fusing. A fusing apparatus of a roller pair system including a fuser roller and a pressure roller has been known as one example of the fusing apparatus described above (for example, see Japanese Unexamined Patent Publication No. 11-38802).

The fuser roller is a roller member having an elastic layer formed on a surface of a hollow core made of a metal such as an aluminum. Generally, a halogen lamp is arranged in the core as a heat source. A temperature control device turns on or off the halogen lamp based upon a signal outputted from a temperature sensor provided on the surface of the fuser roller, thereby controlling the temperature on the surface of the fuser roller to be a target temperature.

The pressure roller is a roller member having a heat-resistant elastic layer made of a silicon rubber formed on a peripheral surface of a core as a cover layer. The pressure roller is in pressed contact with the peripheral surface of the fuser roller, whereby a nip region is formed between the fuser roller and the pressure roller due to an elastic deformation of the heat-resistant elastic layer.

In the configuration described above, the fusing apparatus nips a sheet, having a non-fused toner image formed thereon, at the nip region between the fuser roller and the pressure roller. Due to the rotation of these rollers, the sheet is conveyed, and the toner image on the sheet is fused by a heat from the peripheral surface of the fuser roller to be fixed onto the sheet.

However, in the fusing apparatus of the conventional roller pair system, the fuser roller and the pressure roller are at a room temperature, immediately after a power source is turned on in the morning. The surface temperature of the fuser roller has to increase to a predetermined temperature in order to perform a fusing operation. Therefore, a warm-up time is required. In a stand-by state in which a copying operation is not executed, the surface of the roller has to be maintained to be a predetermined temperature. Accordingly, the roller has to always be heated, even when the copying operation is not carried out, which consumes energy for a heat-retention.

In view of this, a fusing apparatus has been proposed that utilizes a laser power, as a system of efficiently fusing only toner without consuming unnecessary energy (for example, see Japanese Unexamined Patent Publication No. 7-191560).

The apparatus described in Japanese Unexamined Patent Publication No. 7-191560 uses plural lasers in order to heat the toner, whereby a fusing performance, which is insufficient only by a single weak laser, is enhanced. This publication describes that, by virtue of this configuration, an inexpensive laser can be used with low output, resulting in that the whole apparatus can be simplified.

On the other hand, an apparatus has been proposed that includes a unit for preliminarily heating a non-heated recording medium by utilizing an exhaust heat from a sheet heated during the fusing operation in order to aim a reduction in a heat quantity used for the fusing (for example, see Japanese Unexamined Patent Publication No. 2004-20824). This apparatus also includes a cooling unit that derives a heat from the recording medium that has passed through a fusing section. This apparatus also includes a heat transferring unit that transfers a heat, which is derived by the cooling unit, to a recording medium conveying belt that is arranged before the fusing section by a heat pipe and a belt. The recording medium conveying belt preliminarily heats the recording medium that has not yet been subject to the fusing operation and that has the toner image transferred thereon. The heat pipe is used for transferring a large quantity of heat with a small temperature difference (for example, see "Operating Characteristics of the Self-Exciting-Mode-Oscillating-Flow-Heat Pipe" by Takahiro Tanaka, Hiroshi Nomura, and Yasushige Ujiie, on Oct. 29, 2004, at "37$^{th}$ Academic Lecture of College of Industrial Technology" by Research Institute of Industrial Technology, College of Industrial Technology, Nihon University.

However, in the technique described in Japanese Unexamined Patent Publication No. 7-191560, an optical energy conversion efficiency of a laser device, i.e., a ratio of electric power that can optically be outputted as a laser light with respect to electric power applied to the laser device, is low. The laser device generally used has an optical conversion efficiency of 50% or less. Specifically, 50% or more of the electric power is a conversion loss with respect to the applied electric power. The conversion loss described above becomes a heat generated from a laser light source. Therefore, a cooling unit for cooling the generated heat is needed. For example, a unit is needed that cools a heat sink, which is provided at a heat generating portion of the light source, with a unit for blowing wind, such as a fan. Alternatively, a unit is needed, such as a water cooling mechanism, for cooling the heat sink with a water circulating apparatus. Since electric power is separately needed in order to operate the cooling unit, resulting in that the total energy conversion efficiency becomes lower than an optical energy conversion rate for a single laser device. The total energy conversion efficiency is a rate of energy by which a light irradiation can be performed with respect to the total applied electric power necessary for operating the laser, including the electric power applied to the laser device and the electric power applied for cooling.

In the technique described in Japanese Unexamined Patent Publication No. 2004-20824, a heat can be transferred only during the conveyance of a sheet. In the fusing system described in Japanese Unexamined Patent Publication No. 2004-20824, i.e., in the system of heating a sheet with two rollers, the whole sheet is heated with a toner. On the other hand, in the laser fusing system, a laser is irradiated only to a print portion (a portion where the toner is present) for heating this portion. Since the sheet is not directly heated, the heat generated on the sheet is very small. Therefore, in the laser fusing system in Japanese Unexamined Patent Publication No. 2004-20824, the effect of being capable of using the exhaust heat is small.

The apparatus described in Japanese Unexamined Patent Publication No. 2004-20824 includes a first heat pipe serving as a cooling unit for deriving the heat of the sheet, and a second heat pipe that receives the derived heat. The heat of the first heat pipe is transferred to the second heat pipe through a heat transferring unit such as a belt. Further, the heat of the second heat pipe is transferred to the recording medium conveying belt positioned at an entrance to the fusing section. By virtue of the configuration described above, the apparatus is supposed to be complicated. Since there are many components until the heat is transferred to the recording medium, which has not yet been subject to the fusing, from the exhaust heat generated from the recording medium that has already been subject to the fusing, the heat is lost due to a radiation during this period, resulting in that the heat transfer efficiency might be deteriorated.

SUMMARY OF THE INVENTION

The present invention has been made in consideration of the problem described in the foregoing, and an object thereof is to provide an efficient laser fusing apparatus that can reduce optical energy needed to fuse a toner image by utilizing an exhaust heat generated at a laser light source.

In order to achieve the above object, the present invention provides a laser fusing apparatus including: a laser light source for emitting a laser beam; a conveyance belt for conveying a sheet with a toner image being transferred thereon and guiding the sheet to an irradiation region in which the toner image is to be irradiated with the laser beam from the laser light source; a heat pipe including a heat receiving portion to receive heat generated by the laser light source and a heat releasing portion to supply the heat to the conveyance belt; and a fuser control section for controlling the laser light source, so that the laser light source irradiates the laser beam to the toner image when the toner image passes the irradiation region, thereby fixing the toner image onto the sheet, wherein the heat pipe transfers heat from the heat receiving portion to the heat releasing portion, and the conveyance belt heats the sheet and the toner image with the heat supplied from the heat radiation section.

The present invention also provides an image forming apparatus provided with the laser fusing apparatus.

DETAILED DESCRIPTION OF THE INVENTION

Figure 1:
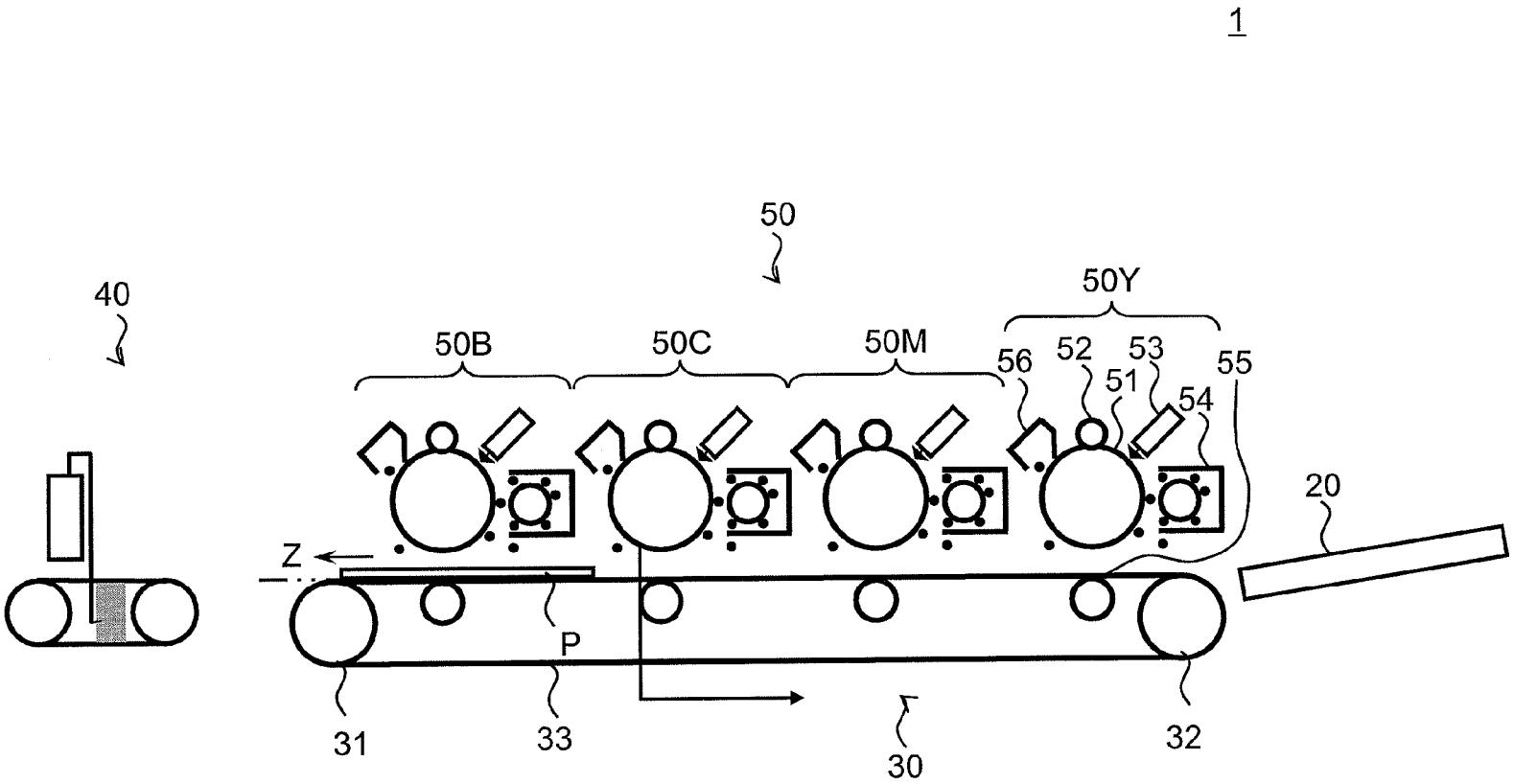
FIG. 1 is an explanatory view schematically illustrating main components of an image forming section and a fusing section included in an image forming apparatus according to the present invention.

The laser fusing apparatus according to the present invention includes a heat pipe having a heat receiving portion that receives a heat generated at the laser light source, and a heat releasing portion that supplies the heat to the conveyance belt, wherein the heat pipe transfers the heat received at the heat receiving portion to the heat releasing portion, while the conveyance belt heats the sheet and the toner image with the heat supplied from the heat releasing portion. Accordingly, the sheet and the toner image can be heated by utilizing the exhaust heat generated when the laser light source emits a laser light. Consequently, the efficient laser fusing apparatus that can reduce optical energy needed for a fusing operation can be realized. Since the sheet that is fed and conveyed becomes a final cooling unit, it is unnecessary to provide another cooling unit to the laser light source. Therefore, electric power needed for the cooling can be reduced.

The image forming apparatus according to the present invention provided with the laser fusing apparatus described above can realize an efficient fusing, because it is provided with the laser fusing apparatus described above. The image forming apparatus can also shorten a warm-up time of the image forming apparatus. The present invention can also provide the image forming apparatus that has a low power consumption and that does not need the heating during the stand-by state.

In the present invention, the laser light source irradiates a laser light having energy sufficient for irradiating and heating the toner image and the sheet to fix the toner image. The specific embodiment thereof is, for example, a laser light source including plural laser devices arranged, and an optical system for directing the laser light emitted from each of the laser devices in a predetermined direction. A configuration in which at least one laser device and a unit for scanning the laser light emitted from the laser device are provided may be employed. However, a simple configuration in which plural laser devices are only arranged without providing the scanning unit is more preferable to the configuration described above. A small-sized inexpensive semiconductor device is extremely preferable for the laser device. In an embodiment, a semiconductor laser is used as the laser light source. However, the present invention is not limited thereto, and a gas laser or an individual laser may be employed as the light source.

In the present invention, the toner image is an image formed by using a toner made of fine colored particles. The specific embodiment thereof is a toner image, which is formed on an electrophotographic photosensitive drum, and is transferred onto a sheet.

In the present invention, the sheet is a printing medium cut into a predetermined size. The specific embodiment thereof is a print sheet cut in a regular size. The printing medium is not limited to a sheet. It may be a transparent or non-transparent resin. In a later-described embodiment, the sheet corresponds to a recording sheet.

In the present invention, the irradiation region is a region where the sheet and the toner image are irradiated by the laser light emitted from the laser light source. For example, the irradiation region is a region where the laser light emitted from the laser light source, which is provided so as to be opposite to the conveyance belt, irradiates the conveyance belt. In the later-described embodiment, the irradiation region corresponds to a predetermined region on the conveyance belt that passes immediately below the laser light source.

In the present invention, the conveyance belt is an endless belt that conveys the sheet, and that transmits the heat from the heat releasing portion to the sheet. The specific embodiment thereof is an endless belt formed by dispersing conductive materials such as a carbon into a resin such as polycarbonate.

In the present invention, the heat pipe is a unique bar or a pipe that is used for transferring a large quantity of heat with a small temperature difference. The specific embodiment thereof is, for example, a metallic narrow pipe having a heat medium such as pure water sealed therein. In the later-described embodiment, the heat pipe corresponds to a narrow tube. The heat pipe derives a heat from the surrounding by the heat receiving portion, and supplies the heat to the surrounding by the heat releasing portion. In the present invention, the heat pipe derives the heat from the laser light source for cooling, and supplies the heat to the conveyance belt, the sheet conveyed by the conveyance belt, and the toner transferred onto the sheet. In the later-described embodiment, a pipe having a layer of PFA (perfluoroalkoxy alkane) formed on a surface of an aluminum as a high thermally-conductive member is used for the heat receiving portion and the heat releasing portion in order to efficiently transfer the heat to the surrounding.

A preferable embodiment of the present invention will be described below.

In the present invention, the heat pipe may be a self-induced vibration type. By virtue of this configuration, a heat transfer can efficiently be realized by using a self-exciting-mode-oscillating-flow-heat pipe having a high heat transfer efficiency, even in a direction in which the heat transfer efficiency is poor by a general heat pipe, e.g., in a direction from top to bottom.

The heat releasing portion of the heat pipe may be positioned at an inner surface of the conveyance belt. By virtue of this configuration, a surplus space for arranging the heat releasing portion is not needed. Further, the heat can be transmitted to the conveyance belt without hindering the sheet conveyed on the outer periphery of the conveyance belt and without disturbing the toner image transferred onto the sheet.

The heat releasing portion of the heat pipe may be arranged to contact with the conveyance belt. By virtue of this configuration, the heat releasing portion is in contact with the conveyance belt, whereby the heat can efficiently be transmitted to the conveyance belt, and hence, the sheet and the toner can efficiently be heated.

The heat releasing portion may be arranged at a position before the sheet reaches the irradiation region. By virtue of this configuration, the sheet is heated beforehand by the heat from the heat releasing portion until the sheet reaches the irradiation region.

The laser fusing apparatus of the present invention may further include a temperature sensor for detecting a temperature of the conveyance belt, wherein the fuser control section controls an irradiation amount of the laser beam according to the temperature of the conveyance belt detected by the temperature sensor. By virtue of this configuration, the irradiation amount can be controlled in order that the optical energy sufficient for the fusing can be supplied without irradiating unnecessary optical energy, whereby the fusing apparatus having a low power consumption can be realized. This is because the optical energy needed for the fusing is different, since the temperature of the sheet is dependent on the temperature of the conveyance belt.

The laser fusing apparatus of the present invention may further include a voltage applying section for applying a voltage to the conveyance belt so that the conveyance belt electrostatically adsorbs the sheet. By virtue of this configuration, the sheet is electrostatically attracted to the conveyance belt to prevent the floating of the sheet, whereby the whole sheet can uniformly and efficiently be heated. Since the adhesion property of the conveyance belt to the sheet is enhanced, the optical energy of the laser light can uniformly be irradiated to a non-fused toner image.

The laser light source may include a plurality of laser devices arranged in a widthwise direction of the sheet, the widthwise direction being perpendicular to a direction along which the sheet is conveyed. By virtue of this configuration, plural laser devices are arranged in the widthwise direction of the sheet, whereby the density of the optical energy needed for the fusing can be secured. A mechanism for scanning the laser light in the widthwise direction of the sheet is unnecessary, which simplifies the structure. On the other hand, when the whole surface of the sheet is to be irradiated with light by a single laser light source, for example, it is necessary to scan the laser light in the widthwise direction of the sheet. Therefore, the apparatus is liable to be complicated, and cost is liable to increase. A wide heat-generating area by the laser can be obtained by the structure of increasing an output with plural lasers than by the structure of increasing an output with a single laser, whereby the heat-releasing area can be increased, and the cooling can be attained within a wide area.

The heat releasing portion may be arranged to contact with the conveyance belt along a length of L that fulfills the following formula: $L \geq V \times 0.3$ wherein L is a length in millimeter of the heat releasing portion in a direction along which the sheet is conveyed, and V is a velocity in millimeter/second at which the sheet is conveyed. By virtue of this configuration, the time sufficient for transmitting the heat from the heat releasing portion to the sheet and the toner via the conveyance belt, i.e., the heating time, can be secured.

The fuser control section may control the laser light source so that the laser light source emits the laser beam when the sheet passes the irradiation region and does not emit the laser beam when the sheet is not in the irradiation region. By virtue of this configuration, the laser light is irradiated only at a timing necessary for fusing the toner image, resulting in that the irradiation of unnecessary laser light can be eliminated, which can suppress the power consumption. Since the laser light is not irradiated to the conveyance belt with the sheet being not present on the conveyance belt, the thermal deterioration of the conveyance belt can be prevented.

Various preferable embodiments described above can be combined to one another.

The present invention will be described below in detail with reference to the drawings. It is to be noted that the embodiments described below are only illustrative of the present invention, and it should not be construed that the present invention is limited to these embodiments. The components having substantially the same functions and same structures are identified by the same numerals throughout the specification and the drawings of the present invention, and the detailed description will be skipped.

One embodiment of the present invention will be described below with reference to FIG. 1.

FIG. 1 is an explanatory view schematically illustrating main components of an image forming section and a fusing section included in an image forming apparatus of the present invention. An image forming apparatus 1 illustrated in FIG. 1 forms a multi-colored or monochrome image on a predetermined recording sheet based upon image data transmitted from respective terminal devices on a network, for example.

The image forming apparatus includes a visible-image forming unit 50 (50Y, 50M, 50C, and 50B), a recording sheet conveying section 30, a fusing apparatus 40, and a feed tray 20.

The image forming apparatus includes four visible-image forming units 50Y, 50M, 50C, and 50B corresponding to each of colors of yellow (Y), magenta (M), cyan (C), and black (B). The visible-image forming unit 50Y makes an image formation by using a toner of yellow (Y). The visible-image forming unit 50M makes an image formation by using a toner of magenta (M). The visible-image forming unit 50C makes an image formation by using a toner of cyan (C). The visible-image forming unit 50B makes an image formation by using a toner of black (B). Specifically, the image forming apparatus employs a so-called tandem type structure in which four visible-image forming units 50 are arranged along a conveyance path of a recording sheet communicating the feed tray 20 for a recording sheet P and the fusing apparatus 40 with each other.

The respective visible-image forming units 50 have substantially the same structure. Specifically, each of the visible-image forming units 50 includes a photosensitive drum 51, a charger 52, a laser light irradiating unit 53, a developing apparatus 54, a transfer roller 55, and a cleaner unit 56. The laser light irradiating unit 53 means a laser light irradiating unit for writing a latent image onto the photosensitive drum. The toners of the respective colors are transferred as being overlaid onto the conveyed recording sheet P.

The photosensitive drum 51 bears an image to be formed thereon. The charger 52 uniformly charges the surface of the photosensitive drum 51 with a predetermined potential. The laser light irradiating unit 53 exposes the surface of the photosensitive drum 51, charged by the charger 52, according to image data inputted to the image forming apparatus, so as to form an electrostatic latent image onto the surface of the photosensitive drum 51.

The developing apparatus 52 makes the electrostatic latent image formed on the surface of the photosensitive drum 51 visible with toners of respective colors. The transfer roller 55 has applied thereto a bias having a polarity reverse to that of the toner, and transfers the formed toner image onto the recording sheet P conveyed by a recording sheet conveying unit 30 described later. The drum cleaner unit 56 removes and collects the toner remaining on the surface of the photosensitive drum 51 after the developing process by the developing apparatus 54, and the transfer of the image formed on the photosensitive drum 51. The transfer of the toner image onto the recording sheet P as described above is repeated for each of four colors of Y, M, C, and B.

The recording sheet conveying unit 30 includes a drive roller 31, an idling roller 32, and a conveyance belt 33. The recording sheet conveying unit 30 conveys the recording sheet P in order that the toner image formed onto the recording sheet P by the visible-image forming unit 50. The drive roller 31 and the idling roller 32 stretch the endless conveyance belt 33. The drive roller 31 is controlled to rotate with a predetermined peripheral speed, whereby the endless conveyance belt 33 is rotated. Static electrical charges are generated on the outer surface of the conveyance belt 33, wherein the conveyance belt 33 conveys the recording sheet P as electrostatically attracting the recording sheet P.

The recording sheet P is conveyed by the conveyance belt 33, and the toner image is transferred thereon, and then, separated from the conveyance belt 33 by the curvature of the drive roller 31 to be conveyed to the fusing apparatus 40.

The fusing apparatus 40 applies an appropriate heat to the recording sheet P, whereby the toner is fused and fixed onto the recording sheet. Accordingly, a robust image is formed.

The fusing apparatus 40 will be described in detail below with reference to FIG. 2.

Figure 2:
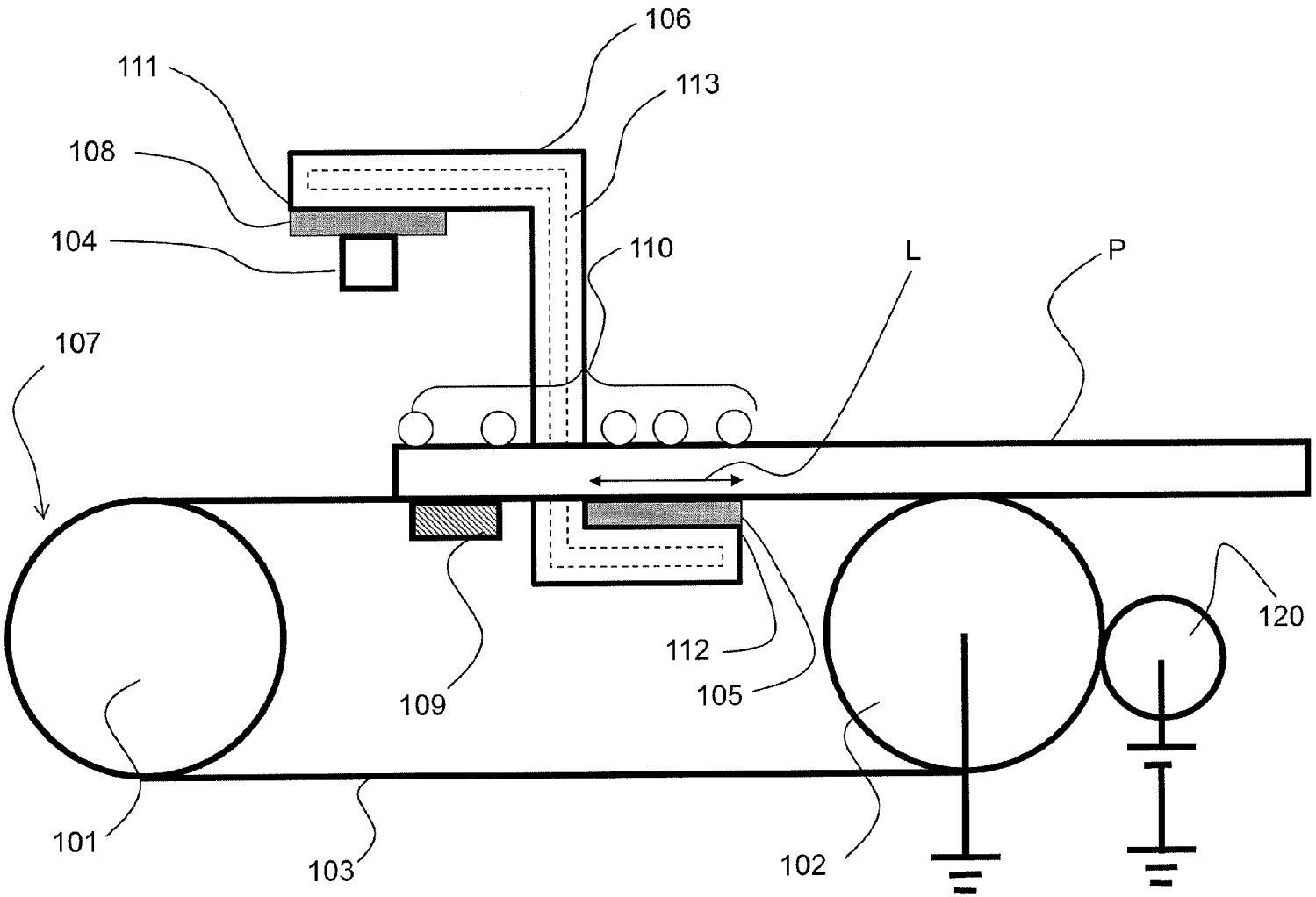
FIG. 2 is an explanatory view illustrating an example of a configuration of a fusing apparatus according to the present invention.

FIG. 2 is an explanatory view illustrating an example of a configuration of the fusing apparatus according to the present invention. The fusing apparatus 40 illustrated in FIG. 2 includes a laser light source 104, a heat lane 106 made of a self-exciting-mode-oscillating-flow-heat pipe and serving as a cooling unit, and a recording sheet conveying apparatus 107 for conveying the recording sheet P.

The recording sheet conveying apparatus 107 includes two tension rollers 101 and 102, a charging roller 120, and the conveyance belt 103 having a heat-resistant endless belt. The recording sheet P having thereon a non-fused toner image (toner 110) is conveyed onto the conveyance belt 103. A drive unit, not illustrated, is connected to the tension roller 101, wherein the tension roller 101 rotates by the drive unit.

Figure 3:
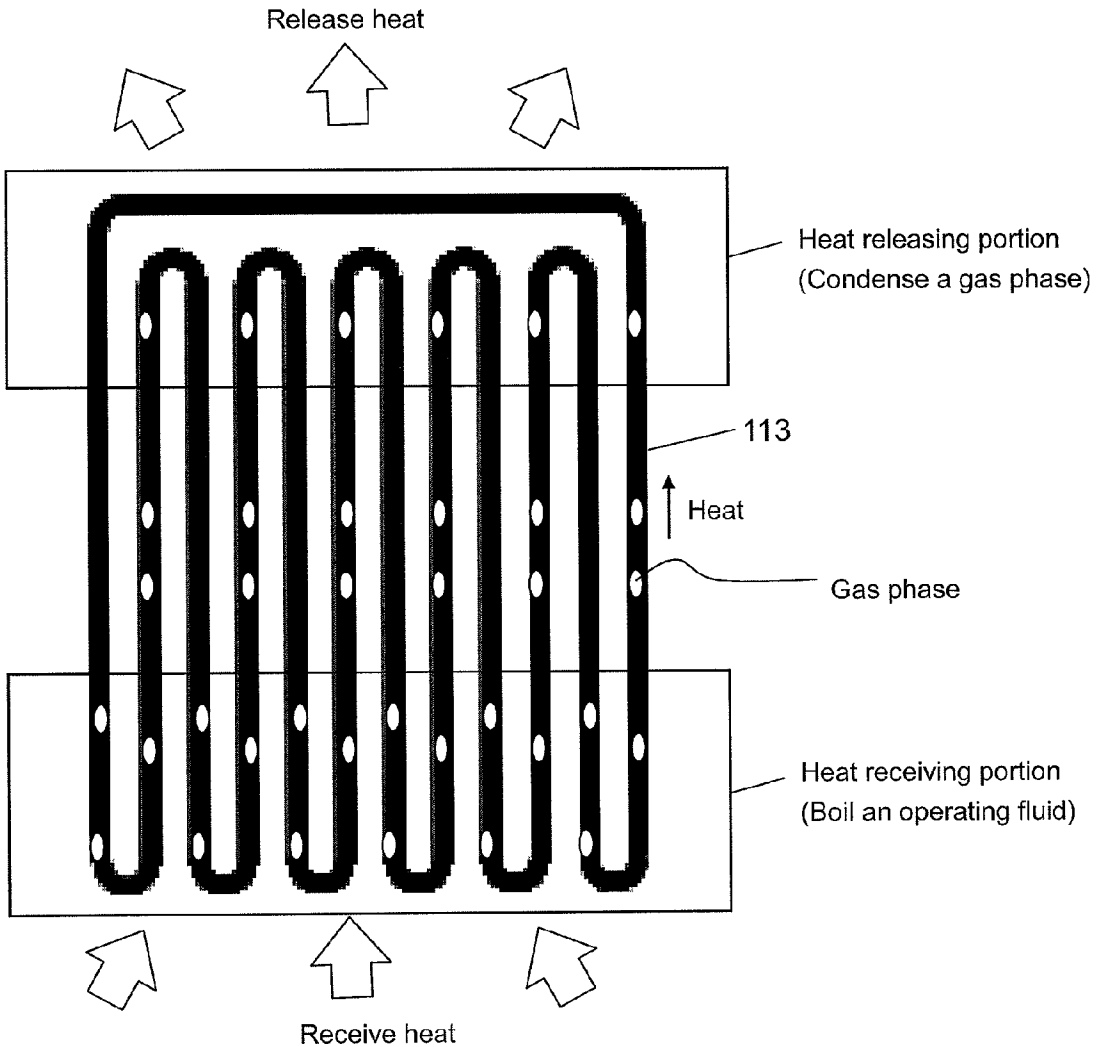
FIG. 3 is an explanatory view illustrating a principle of a heat transfer on a heat lane according to the present invention.

In the heat lane 106, a single narrow tube 113 having a heat medium sealed therein is arranged as being wound in a reciprocal manner between a heat generating portion of the laser light source 104 and the conveyance belt 103. FIG. 3 illustrates an image of an operation principle of the heat lane. A metal pipe having sealed therein a heat medium (e.g., pure water) and having an inner diameter of 1 mm and a thickness of 0.5 mm is used as the narrow tube 113 arranged between the heat receiving portion and a heat releasing portion. This metal pipe is wound many times between the heat generating portion and the heat releasing portion in a reciprocal manner. A material having a large thermal conductivity, such as an aluminum, silver, or copper, is used as the material of the narrow tube 113.

The heat medium sealed in the narrow tube 113 has a gas phase portion and a liquid phase portion alternately present. At the heat receiving portion, the temperature of the heat medium in the liquid phase increases due to the absorbed heat, whereby the heat medium comes to a boil to intermittently emit vapor bubbles, and at the same time, the pressure thereof increases. On the other hand, at the heat releasing portion, the vapor pressure drops, and the temperature of the heat medium drops, due to the contraction or condensation of the vapor bubbles with the cooling action. By a pressure oscillation self-excitingly caused due to the pressure difference between the heat receiving portion and the heat releasing portion, the heat medium having the gas phase and the liquid phase sealed in the narrow tube moves toward the heat releasing portion having low pressure from the heat receiving portion having high pressure. Because of the movement of the heat medium, the transfer of a latent heat and the transfer of a sensible heat are simultaneously carried out. Since the heat medium in the tube is circulated by an oscillating force, the heat lane 106 is insusceptible to force of gravity, compared to a conventional heat pipe, whereby the change in a heat transfer ability according to a mounted posture is reduced.

It is further desirable that a check valve is provided in the narrow tube 113 in order to flow the fluid in the heat lane in a fixed direction.

The laser light source 104 is a semiconductor laser. The semiconductor laser has a merit of being inexpensive, and being capable of downsizing, compared to the other lasers including a carbon dioxide laser. The semiconductor laser can also emit a laser light having an optional wavelength in a wide range in a region of 400 nm to 1000 nm according to a combination of the semiconductor or a composition of a material. In recent years, a semiconductor laser that has a high output of several watts, or a semiconductor laser array having a high output of tens of watts are available in a market, and the output thereof tends to increase in the future.

The laser light source 104 irradiates the laser light in the direction of the recording sheet conveying apparatus 107 (in the downward direction), and is in contact with the heat receiving portion 111 of the heat lane through a high thermally-conductive member 108 on its reverse surface. The heat releasing portion 112 of the heat lane is in contact with the conveyance belt 103 through another high thermally-conductive member 105.

A material having a large thermal conductivity, such as an aluminum, silver, or copper, is used for the high thermally-conductive members 105 and 108. In the present embodiment, an aluminum plate having a thickness of 0.5 mm is used as the high thermally-conductive members 105 and 108. The contact surface between the high thermally-conductive member 108 and the laser light source is lightly coated (about 10 μm) with an unillustrated PFA (perfluoroalkoxy fluorine resin), which is a non-conductive material. The PFA has a function of keeping an insulating property on the contact surface. Other than the PFA, a material of a PTFE (polytetrafluoroethylene), or a FEP (fluorinated ethylene propylene) may be used. The material is not limited thereto, so long as it has an insulating property.

The contact surface between another high thermally-conductive member 105 and the conveyance belt 103 is lightly coated (about 10 μm) with an unillustrated PFA having low friction coefficient. The PFA has a function of reducing the friction resistance on the contact surface. Other than the PFA, a material of a fluorine resin such as a PTFE (polytetrafluoroethylene), or a FEP (copolymer of tetrafluoroethylene and hexafluoropropylene) may be used. The material is not limited thereto, so long as it reduces the friction resistance.

The contact surface between the high thermally-conductive member 105 and the sheet conveyance belt 103 transfers the heat generated at the laser light source 104 to the conveyance belt 103 through the heat lane. The region where the heat releasing portion of the heat lane is in contact with the conveyance belt is in contact with the upstream side in the sheet conveying direction from the position where the laser light irradiates the sheet conveyance belt. With this structure, the non-fused toner image is preliminarily heated immediately before it is irradiated with the laser light, thus efficient.

In FIG. 2, the heat generated from the laser light source 104 is transmitted to the heat receiving portion of the heat lane via the high thermally-conductive member 108. However, different from this structure, the laser light source 104 may be in direct contact with the heat receiving portion 111 of the heat lane so as to transmit the heat. Similarly, the conveyance belt 103 may be in direct contact with the heat releasing portion 112 of the heat lane so as to transmit the heat. When the laser light source 104 is compact, the contact area cannot sufficiently be secured at the heat receiving portion 111 of the heat lane, resulting in that the release of the heat from the laser light source 104 might be insufficient. Similarly, there may be the case in which the contact area cannot sufficiently be secured at the heat releasing portion 112 of the heat lane. Accordingly, it is preferable that the contact area with the heat lane is increased with the use of the high thermally-conductive members 105 and 108. A high thermally-conductive grease may appropriately be used in order to enhance adhesion property.

Figure 4:
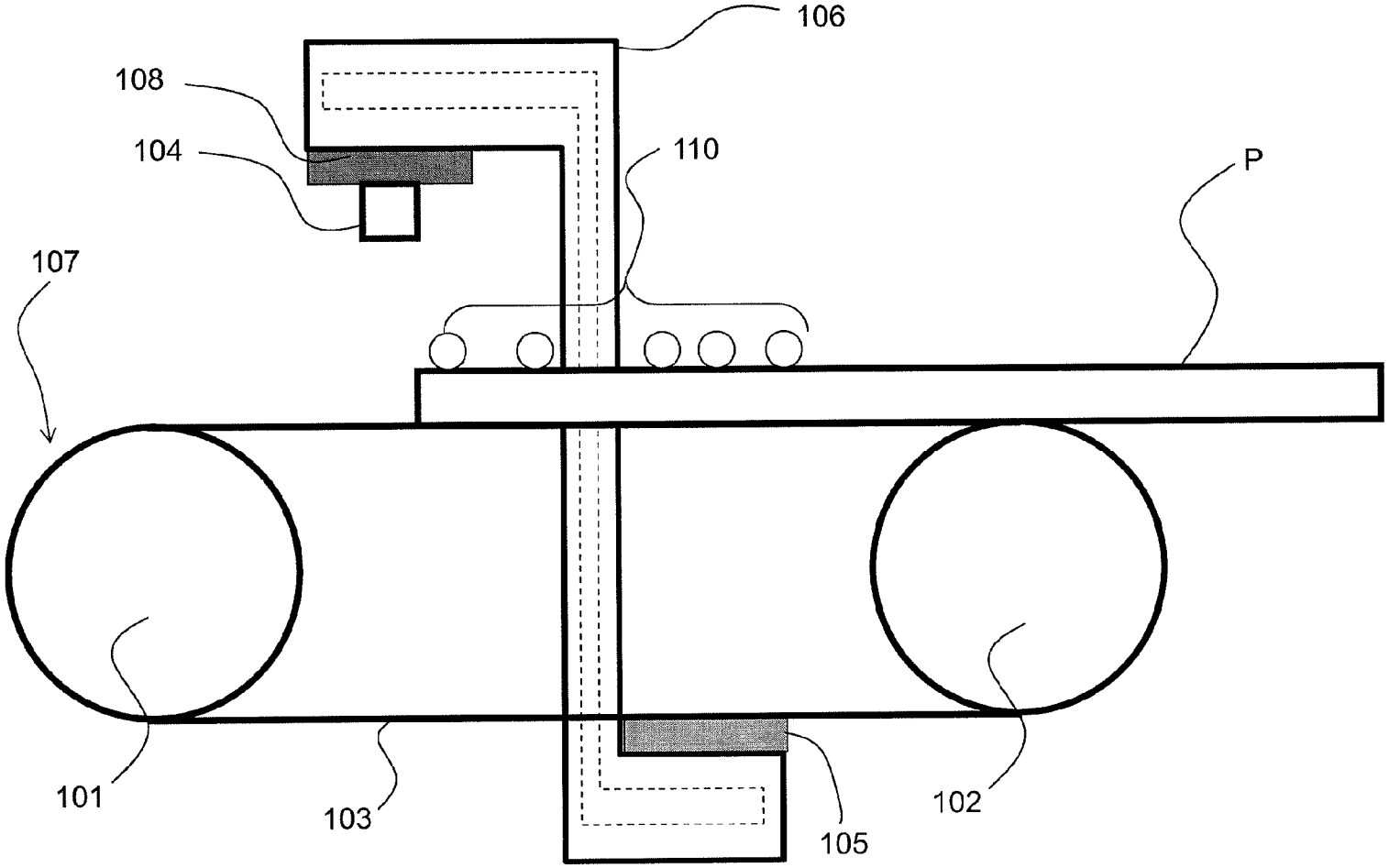
FIG. 4 is an explanatory view illustrating a first modification of the fusing apparatus illustrated in FIG. 2.

FIG. 4 is an explanatory view illustrating a modification of the fusing apparatus 40. As illustrated in FIG. 4, the heat releasing portion may be arranged at the outside of the conveyance belt 103 so as to heat the surface (outer peripheral surface) of the conveyance belt 103. With this structure, the surface of the belt can directly be heated.

Figure 5:
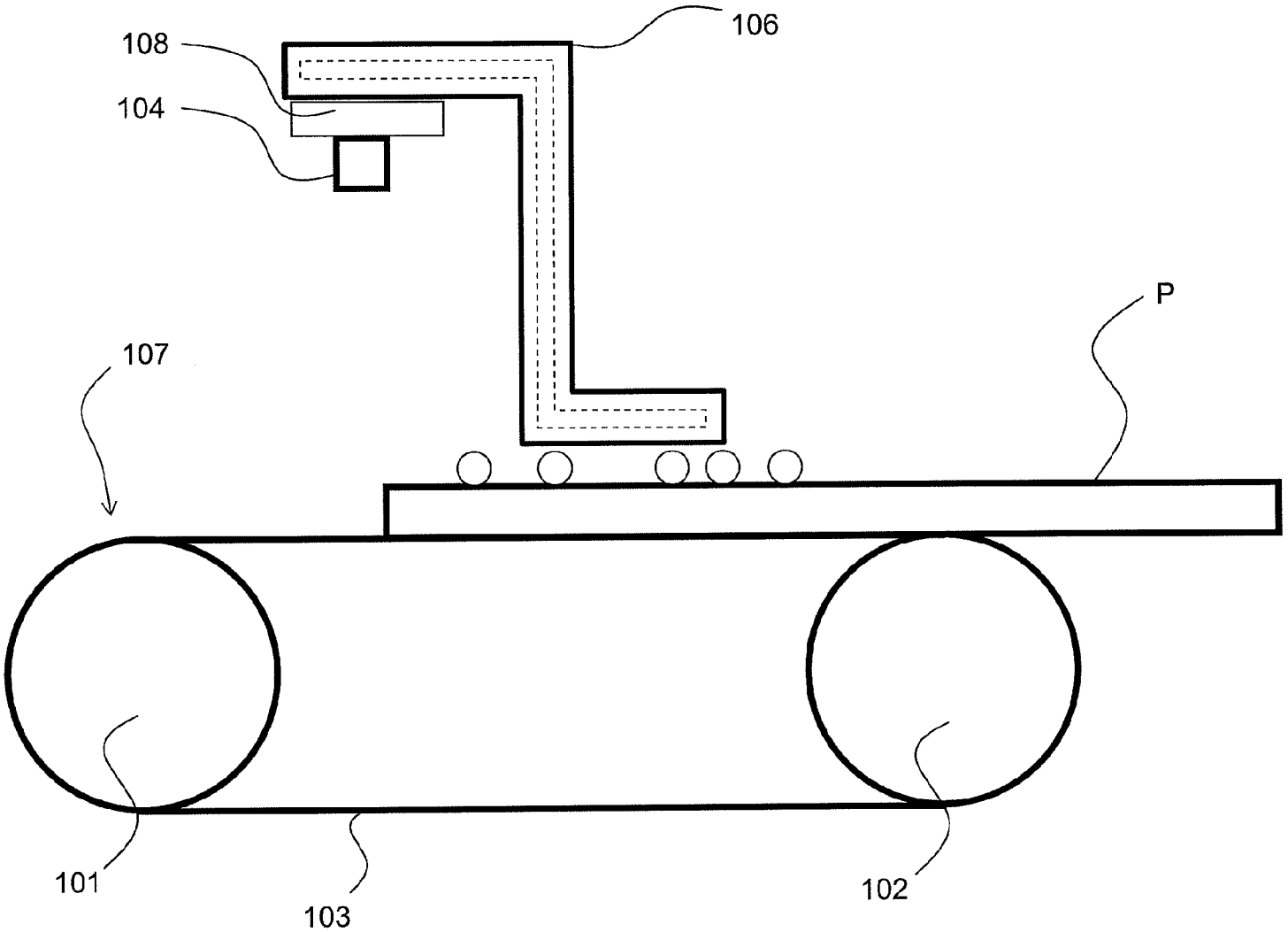
FIG. 5 is an explanatory view illustrating a second modification of the fusing apparatus illustrated in FIG. 2.

FIG. 5 is an explanatory view illustrating a modification of the fusing apparatus 40. As illustrated in FIG. 5, the heat releasing portion of the heat lane may be made very close to the surface of the recording sheet having the non-fused toner image thereon, but not in contact therewith, so as to transmit the heat to the recording sheet P.

FIGS. 2 to 5 illustrate only one example of the present embodiment. The other structures may be employed, so long as the heat releasing portion of the heat lane is arranged at the position where the conveyance belt and the recording sheet P are preliminarily heated with the heat generated from the laser light source 104.

With this structure, the laser light source 104 generates heat by itself due to an energy conversion loss, but releases heat to the recording sheet through the conveyance belt 103 (is cooled by the recording sheet) due to the heat transfer of the heat lane. Therefore, the temperature rise of the laser light source 104 can be suppressed.

As illustrated in FIG. 2, the conveyance belt 103 is made of a material formed by dispersing a conductive material such as carbon into a resin such as a polycarbonate, vinylidene fluoride, polyamideimide, or polyimide (PI). The charging roller 120 is in contact with the surface of the conveyance belt 103. The charging roller 120 is connected to a power source, and applies a voltage to the surface of the conveyance belt 103. When the voltage is applied from the charging roller 120, the surface (outer peripheral surface) of the conveyance belt 103 electrostatically attracts the recording sheet P. The electrostatic attraction causes the conveyance belt 103 and the recording sheet P to be in intimate contact with each other, whereby the heat on the conveyance belt can efficiently be transmitted to the recording sheet P.

Figure 6:
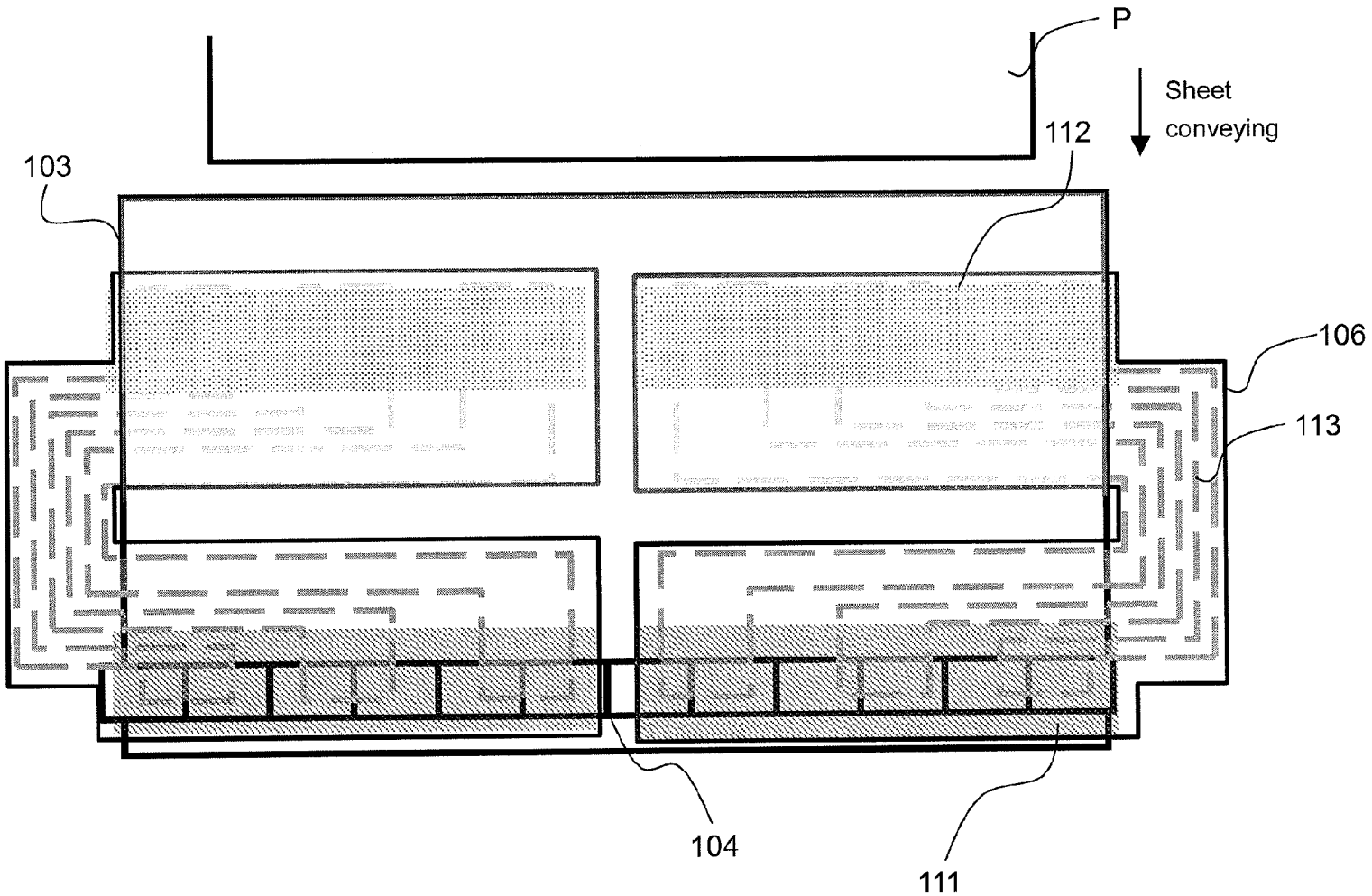
FIG. 6 is an explanatory view illustrating the fusing apparatus according to the present invention viewed from top.

FIG. 6 is an explanatory view illustrating the laser light irradiating apparatus in FIG. 2 viewed from directly above in the sheet conveying direction. As illustrated in FIG. 6, plural laser light sources 104 are arranged in the direction perpendicular to the sheet conveying direction. When the whole surface of the sheet is irradiated with a single laser, the laser has to be scanned in not only the sheet conveying direction but also the direction perpendicular to the sheet conveying direction. This process takes much time for the fusing process, so that there is a limitation in a high-speed fusing.

The apparatus might be complicated, or the cost might be increased, in order to scan the laser. On the other hand, the laser light sources 104 are arranged on a line in the direction perpendicular to the sheet conveying direction. With this structure, it becomes unnecessary to scan the laser in the direction perpendicular to the sheet conveying direction.

Therefore, the apparatus can be used with the minimum structure, and further, the apparatus can make the fusing process with high speed.

In FIG. 6, the heat receiving portion 111, serving as the cooling unit, of the heat lane 106 is formed on the laser light sources 104 via the high thermally-conductive member 108. The heat releasing portion 112 of the heat lane reaches the inner side of the sheet conveyance belt 103 at the inside of the recording sheet conveying apparatus 107. FIG. 6 illustrates the heat lane that employs plural narrow tubes, each of which is wound once in a reciprocal manner in the heat lane. However, the present invention is not limited thereto. The structure in which a single narrow tube 113 is wound many times in a reciprocal manner may be employed as illustrated in FIG. 3.

As illustrated in FIG. 2, a thermistor 109 serving as a temperature detecting unit (temperature sensor) to detect the temperature of the conveyance belt 103 is provided at the inner peripheral surface of the conveyance belt 103.

Figure 7:
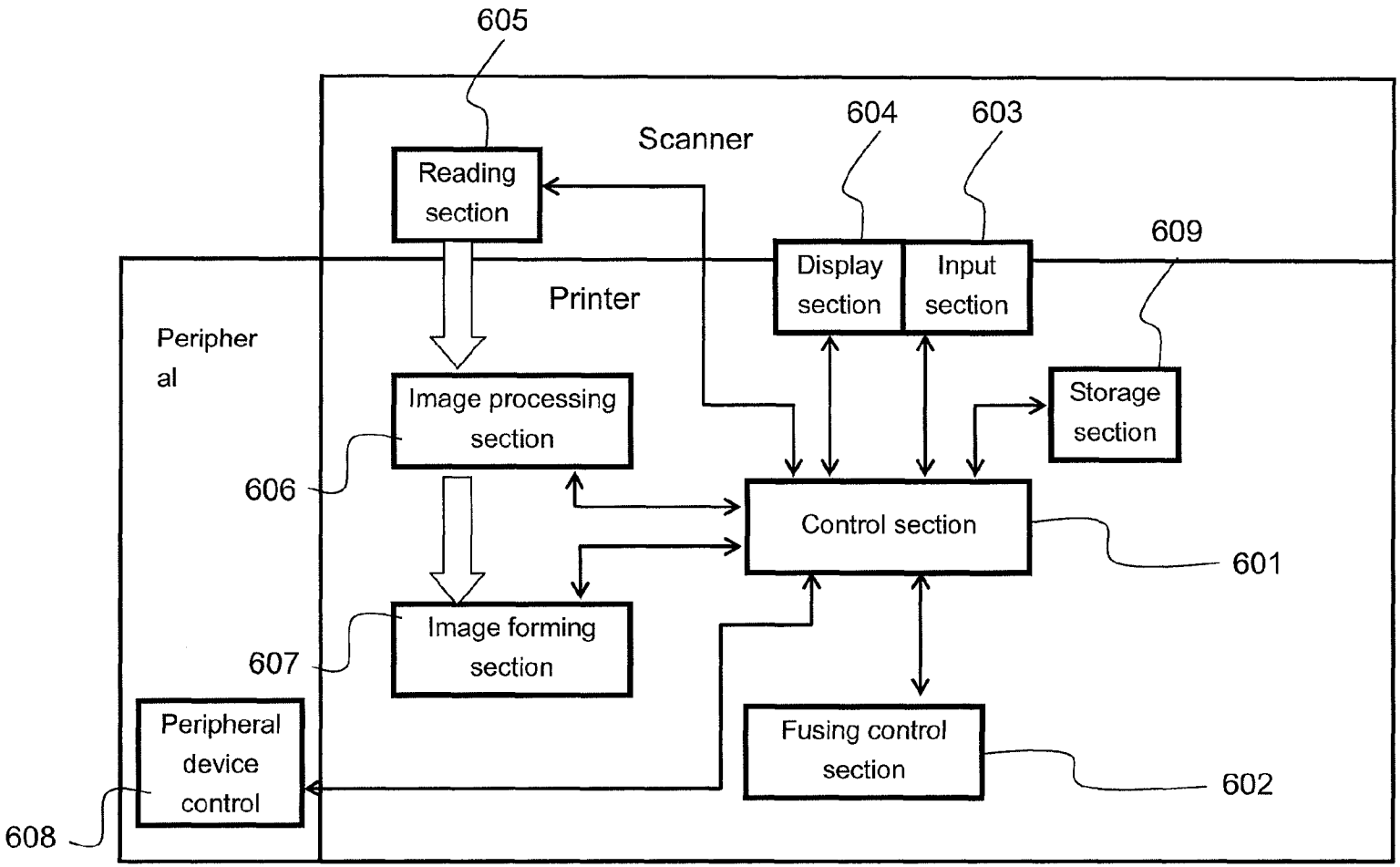
FIG. 7 is a block diagram illustrating respective operation sections and a fuser control section composing the image forming apparatus according to the present invention, and a flow of a control signal among the respective sections.

The light irradiation amount of the laser light source 104 is controlled by the fusing control section 602 illustrated in FIG. 7 based upon the detected temperature by the thermistor 109. The position where the thermistor 109 is arranged is not limited to the position described above, so long as the thermistor 109 can appropriately detect the temperature of the conveyance belt 103 or the temperature of the recording sheet P.

A temperature detecting unit other than the thermistor 109 may be used.

When the recording sheet P having the non-fused toner image formed thereon is preliminarily heated by the heat generated from the laser light source 104, the recording sheet P and the toner 110 are warmed before the laser light is irradiated.

Accordingly, when the toner 110 is heated and fused by the laser light, the laser irradiation amount can be suppressed.

When the fusing operation is performed immediately after the warm-up of the fusing apparatus at room temperature (20° C.), for example, there is little heat generation from the laser light source 104, so that the back surface of the recording sheet P is not heated. Therefore, the toner 110 present on the front surface of the recording sheet P has substantially the room temperature, and the energy required for fusing the toner 110 is a theoretical value of 0.000795 J/mm$^2$. The case where a normal polyester toner is used will specifically be described, for example. When the toner 110 having a specific heat of 1.42 J/g·° C., a specific gravity of 0.000817 g/mm$^3$, a thickness of 0.016 mm, a filling rate of 0.476 (a volume of a presence of the toner per unit volume), and a room temperature is fused at 110° C. (the toner temperature required for fusing the toner), the optical irradiation energy required for the fusing is 0.000795 J/mm$^2$ (=specific heat×specific gravity×filling rate×(110° C.−20° C.)).

On the other hand, when the recording sheet P is continuously fed, the heat generated from the laser light source 104 due to the energy conversion loss is transmitted to the conveyance belt 103 via the heat lane. When the temperature detected by the thermistor is 40° C., i.e., when the non-fused toner image is preliminarily heated to 40° C., the optical irradiation energy required for fusing the toner 110 is 0.000618 J/mm$^2$ (=specific heat×specific gravity×filling rate×(110° C.−40° C.)). This indicates that 78% (=0.000593/0.000795) of the optical irradiation amount is sufficient, with respect to the case in which the toner image has a room temperature.

The relationship between the temperature detected by the thermistor and the temperature of the non-fused toner image (here, the temperature at the interface between the lowermost toner layer and the sheet) can be predicted beforehand from a result of a one-dimensional thermal analysis under the conditions described below.

The configuration and the initial condition of the thermal analysis are as stated below.

The structure of the high thermally-conductive member, the conveyance belt, and the recording sheet used for the thermal analysis will firstly be described. The high thermally-conductive member 105 is made of an aluminum having a thickness of 0.5 mm, and a layer made of a PFA and having a thickness of 0.01 mm is formed on the surface thereof as the high thermally-conductive surface layer. The conveyance belt 103 is made of a PI resin having a thickness of 0.05 mm. The sheet conveyed on the conveyance belt 103 has a thickness of 0.1 mm, while the thickness of the toner layer formed on the sheet is 0.016 mm.

The initial condition will next be described. The initial temperature of the toner and the recording sheet is 20° C., and the conveyance speed of the recording sheet is 200 mm/sec. The initial temperature of the high thermally-conductive member and the conveyance belt is set to three levels, which are 30° C., 40° C., and 50° C. The preliminary heating time is 0.4 second for the respective cases. The preliminary heating time is a period from when the recording sheet having the non-fused image formed thereon is brought into contact with the conveyance belt 103 to when the recording sheet reaches the laser irradiation region by the laser light source 104 of the fusing apparatus 40.

Figure 9:
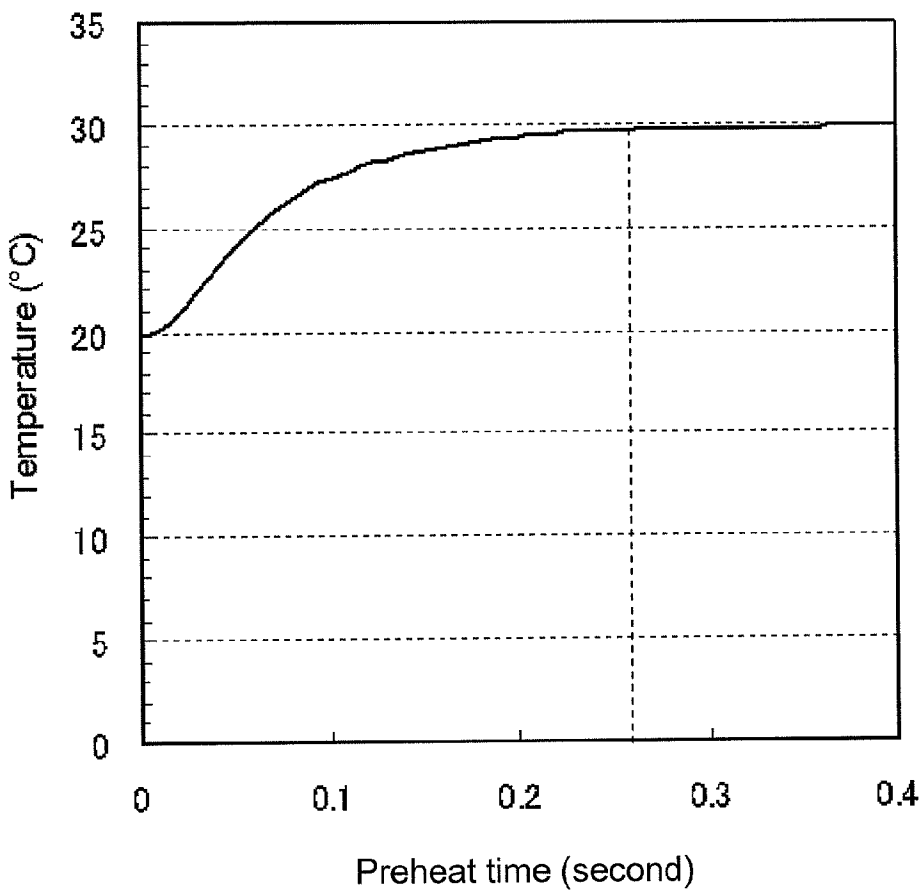
FIG. 9 is a first graph illustrating a result of performing a one-dimensional analysis to a relationship between a preliminary heating time of a conveyance belt and a toner temperature according to the present invention (in case where an initial temperature of the conveyance belt is 30° C.)
Figure 10:
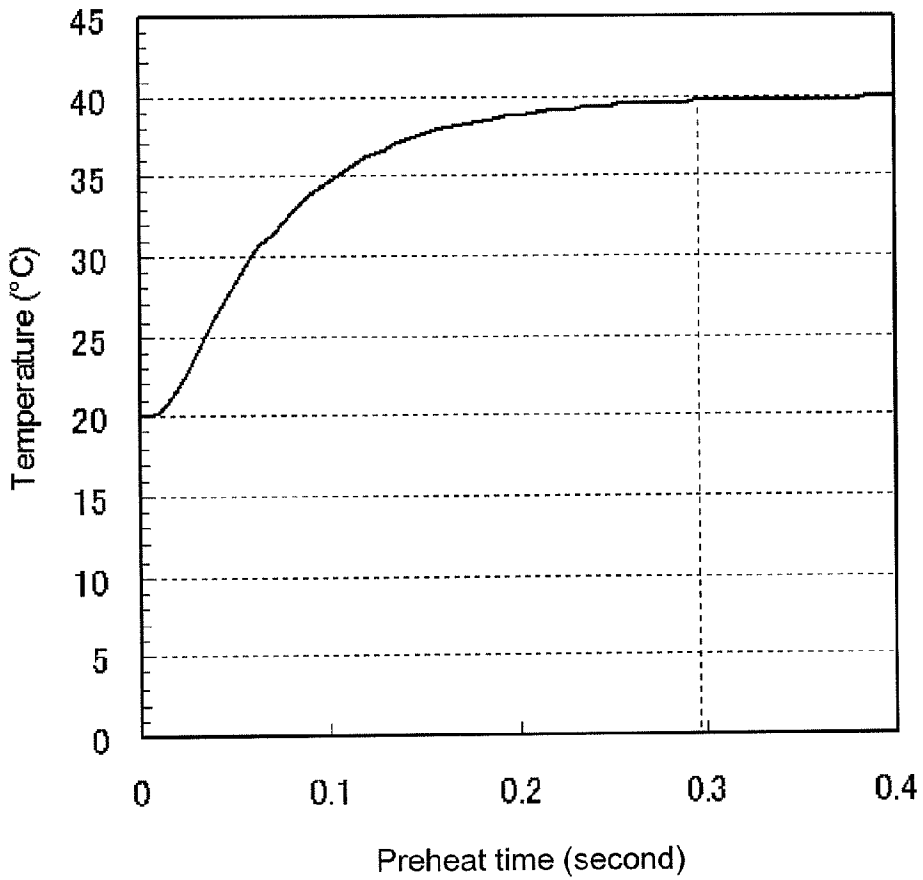
FIG. 10 is a second graph illustrating a result of performing a one-dimensional analysis to a relationship between a preliminary heating time of a conveyance belt and a toner temperature according to the present invention (in case where an initial temperature of the conveyance belt is 40° C.)
Figure 11:
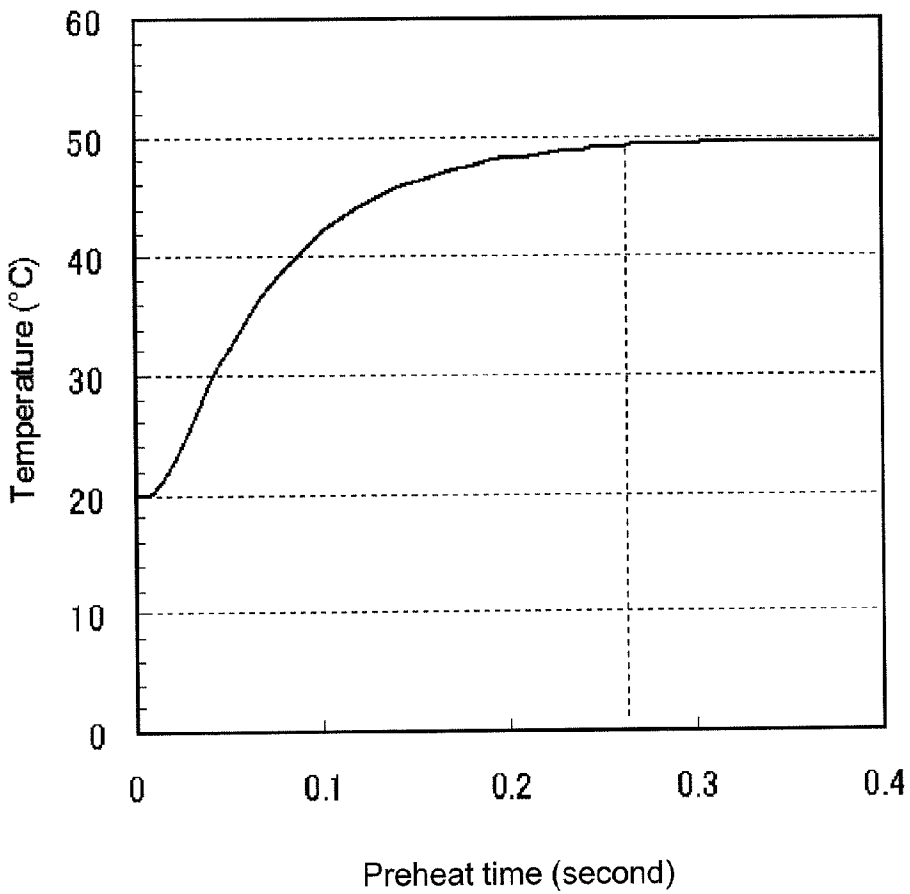
FIG. 11 is a third graph illustrating a result of performing a one-dimensional analysis to a relationship between a preliminary heating time of a conveyance belt and a toner temperature according to the present invention (in case where an initial temperature of the conveyance belt is 50° C.).

FIGS. 9 to 11 are graphs illustrating the result of the one-dimensional analysis for the relationship between the preliminary heating time of the conveyance belt and the toner temperature. FIGS. 9, 10, and 11 respectively correspond to the cases where the temperature detected by the thermistor 109 for detecting the temperature of the conveyance belt 103, i.e., the initial temperature of the conveyance belt 103, is 30° C., 40° C., and 50° C. As for the relationship between the temperature of the conveyance belt 103 and the temperature of the toner on the recording sheet, the toner temperature becomes substantially equal to the initial temperature of the conveyance belt for at least the preliminary heating time of 0.3 second or more. Therefore, under the condition where the preliminary heating time is 0.4 second, the temperature detected by the thermistor 109 can be regarded as the toner temperature. Specifically, it is desirable that the time for the contact between the heat releasing portion 112 of the heat lane 106 and the conveyance belt 103 is set to be 0.3 second or more. With this, the toner is sufficiently preliminarily heated. Specifically, when the process speed is defined as S (mm/s), the optimum width L (see FIG. 2) in the sheet conveying direction at the heat releasing portion of the heat lane is set to be at least L=0.3×S or more. When the sheet is brought into contact with the heat releasing portion with this width, the heat generated by the heat lane can sufficiently be transmitted to the toner portion.

When the time for the contact between the heat releasing portion of the heat lane and the conveyance belt 103 is short for the design matter, the heat of the heat lane might not sufficiently be transmitted to the conveyance belt 103. In this case, the temperature detected by the thermistor 109 and the temperature of the toner 110 are different from each other. Therefore, an appropriate temperature conversion table considering the temperature difference may be created from the result of the calculation described above (FIGS. 9, 10, and 11).

The temperature conversion table is created in which the relation of the laser light irradiation amount to the temperature detected by the thermistor 109 is calculated, based upon the theoretical value described above. The temperature conversion table is read, based upon the temperature detected by the thermistor 109 so as to decide the light irradiation amount, whereby the toner image can be fused with the minimum light irradiation amount. The temperature conversion table described above is stored in a later-described storage section 609 illustrated in FIG. 7.

The technique of obtaining the values in the temperature conversion table from the calculation is only illustrative, and the temperature conversion table may be created according to another technique.

FIG. 7 is a block diagram illustrating the respective operation sections and the control section constituting the image forming apparatus, and a flow of a control signal among the respective sections.

The image forming apparatus, which is illustrated by the block diagram in FIG. 7 as a whole, is a composite machine including a scanner, a printer, and a peripheral device, and corresponds to the image forming apparatus 1 in FIG. 1, for example. The image forming apparatus in FIG. 7 includes an image reading section 605, an image processing section 606, an image forming section 607, the fusing control section 602, the storage section 609, a peripheral device control section 608, an input section 603, and a display section 604.

The image reading section 605 reads an image of a document. The image processing section 606 converts the read document image into an appropriate electric signal so as to generate image data. The image forming section 607 prints and outputs the generated image data. The fusing control section 602 controls the laser light irradiation of the fusing section (not illustrated in FIG. 7). The storage section 609 stores the time taken until the recording material reaches the laser irradiation region in the fusing apparatus after a receipt of a print start signal based upon the process speed and a signal from an actuator that detects a sheet conveyance start signal. The peripheral device control section 608 controls a peripheral device such as a finisher or a sorter, which is a post-processing apparatus. The input section 603 and the display section 604 are an operation portion of the image forming apparatus.

The control section 601 performs at least a control described below. Firstly, the control section 601 checks the data stored in the storage section 609 beforehand based upon print position information of the image information received from the image processing section 606. The print position information indicates a command as to which position in every one page the printing is performed for a print job. The control section 601 then transmits a laser light output value, which is calculated from the temperature conversion table based upon the print position information and the thermistor detection temperature information, to the fusing control section 602.

The fusing control section 602 drives the conveyance belt 103, and makes a control of irradiating the laser light, based upon the received print position information and the calculated output value of the laser light.

The fusing control section 602 also monitors the signal of the unillustrated actuator that detects the conveyance of the recording sheet P. The fusing control section 602 makes a control of applying a voltage to the conveyance belt 103 based upon the above-mentioned signal.

Figure 8:
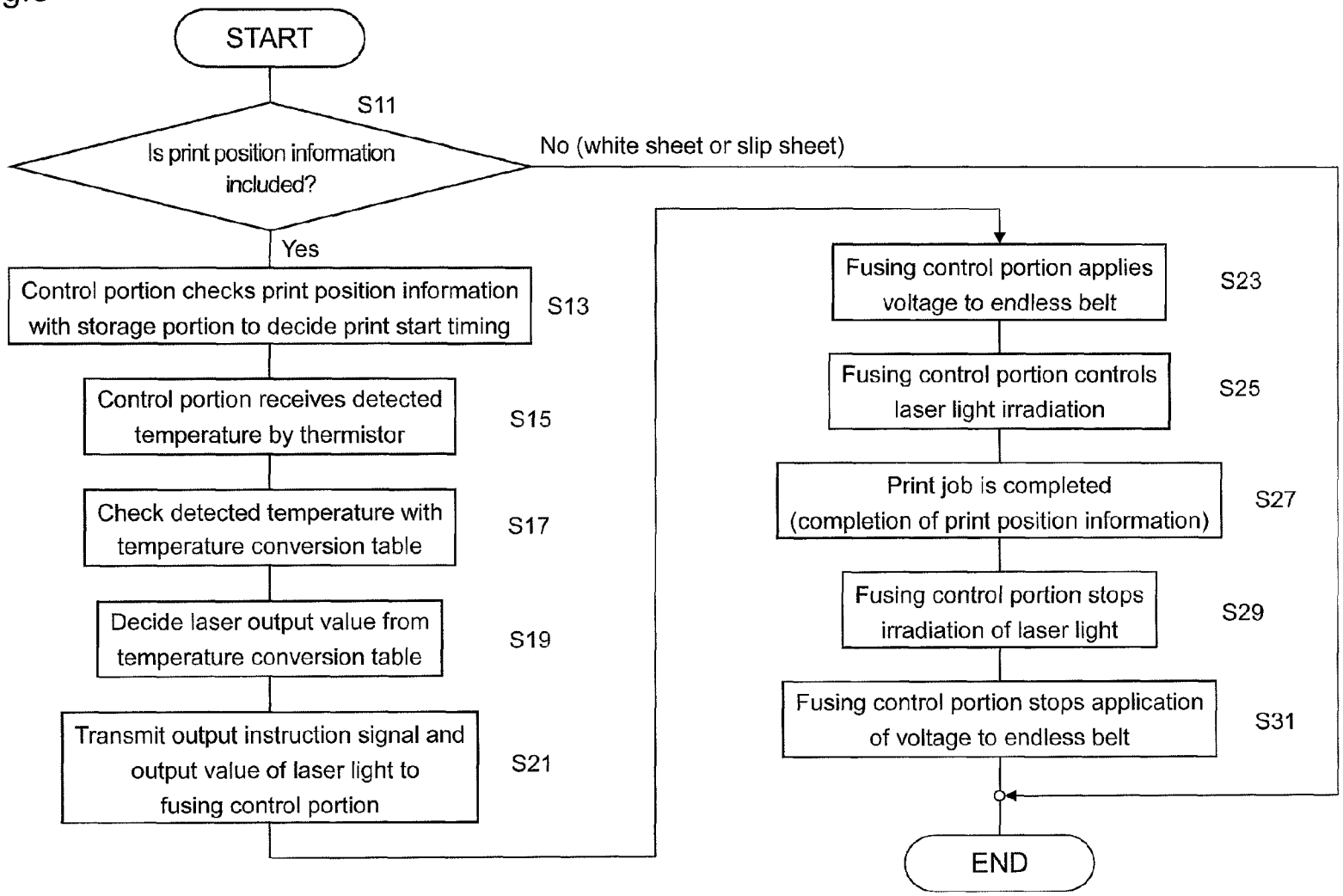
FIG. 8 is a flowchart illustrating a procedure of a copying operation at the fuser control section provided to the image forming apparatus according to the present invention.

FIG. 8 is a flowchart illustrating a procedure of a copying operation of the control section provided to the image forming apparatus.

Even when a user makes a print instruction from a screen of a printer driver, not illustrated, of the image forming apparatus 1, the control same as that in this flowchart is executed based upon the print instruction signal by the user.

When the user depresses an unillustrated copy button on the input section 603 after he/she places an original document, which he/she intends to make a copy, onto a scanner, or onto a document table, the control section 601 receives a signal (print instruction signal) through the depression by the user. The control section 601 controls the image reading section 605 of the scanner to read the document image in response to the signal, for example. Then, the control section 601 allows the image processing section 606 to make an image process of the signal read by the image reading section 605. The control section 601 then receives the print position information from the image processing section 606.

After receiving the information from the image processing section 606, the control section 601 determines whether the received information includes the print position information or not (step S11). If the print position information is not included, the control section 601 determines that it is not the execution of the print job, so that the control section 601 executes nothing (No in step S11). On the other hand, the received information includes the print position information (Yes, in step S11), the control section 601 decides the print start timing by referring to the storage section 609 (step S13). The control section 601 also receives the temperature detected by the thermistor 109 (step S15).

The control section 601 refers to the temperature conversion table, which is created beforehand, by using the temperature detected by the thermistor 109 (step S17), so as to decide the output value of the laser irradiation amount corresponding to the detected temperature (step S19). Then, the control section 601 transmits the decided output value and the output signal to the fusing control section 602 so as to make a control of irradiating the laser light from the laser light source 104 (step S21).

The fusing control section 602 also makes a control of applying the bias voltage to the conveyance belt 103 (step S23). The fusing control section 602 controls the irradiation of the laser light from the laser light source 104 during the execution of the print job (step S25).

After the print job is completed (step S27), the fusing control section 602 stops the output of the laser light by the laser light source 104 (step S29). Then, the fusing control section 602 stops the application of the bias voltage to the conveyance belt 103 (step S31).

The fusing control section 602 may monitor the signal from the unillustrated actuator, which detects the conveyance of the recording sheet P, and recognize the conveyance of the sheet based upon this signal so as to control the laser light source 104 and the bias voltage. For example, the fusing control section 602 may count a moving time of the recording sheet P after the recording sheet P is fed from the feed tray 20 by an unillustrated feed roller so as to calculate the time until the recording sheet P reaches the laser irradiation region. Based upon the calculated time, the fusing control section 602 may control the laser light source 104, the conveyance belt 103, and the application and stop of the bias voltage.

As described above, the recording sheet P, which is conveyed by the conveyance belt 103 (FIG. 2) and which has a non-fused toner image formed thereon, is in intimate contact with the conveyance belt 103, and the laser light is irradiated based upon the print position information. During the sheet feeding operation, the laser light is irradiated based upon the print position information obtained from the image information. Therefore, electric power is not needed except for the period during the sheet feeding operation, i.e., not needed upon the warm-up or in the stand-by state. Accordingly, the fusing apparatus and the image forming apparatus having reduced power consumption can be realized.

The flowchart in FIG. 8 illustrates the case in which the fusing control section 602 controls to stop the irradiation of the laser light source 104. However, this control is not limited to be executed by the fusing control section 602. The irradiation of the laser light source 104 may be controlled based upon only the signal of instructing the irradiation from the laser light source 104 from the control section 601.

Other than the above-mentioned embodiments, various modifications are possible for the present invention. It should not be construed that these modifications do not belong to the scope of the present invention. The present invention should encompass the meanings equivalent to the scope of the claims and all modifications within the scope.

What is claimed is:

1. A laser fusing apparatus, comprising:

a laser light source for emitting a laser beam;

a conveyance belt for conveying a sheet with a toner image being transferred thereon and guiding the sheet to an irradiation region in which the toner image is to be irradiated with the laser beam from the laser light source;

a heat pipe including a heat receiving portion to receive heat generated by the laser light source and a heat releasing portion to supply the heat to the conveyance belt;

a fuser control section for controlling the laser light source, so that the laser light source irradiates the laser beam to the toner image when the toner image passes the irradiation region, thereby fixing the toner image onto the sheet; and a temperature sensor for detecting a temperature of the conveyance belt, wherein the heat pipe transfers heat from the heat receiving portion to the heat releasing portion, the conveyance belt heats the sheet and the toner image with the heat supplied from the heat radiation section, and the fuser control section controls an irradiation amount of the laser beam according to the temperature of the conveyance belt detected by the temperature sensor.

2. The laser fusing apparatus according to claim 1, wherein the heat pipe is a self-induced vibration type.

3. The laser fusing apparatus according to claim 1, wherein the heat releasing portion of the heat pipe is positioned at an inner surface of the conveyance belt.

4. The laser fusing apparatus according to claim 1, wherein the heat releasing portion of the heat pipe is arranged to contact with the conveyance belt.

5. The laser fusing apparatus according to claim 1, wherein the heat releasing portion is arranged at a position before the sheet reaches the irradiation region.

6. The laser fusing apparatus according to claim 1, further comprising:

a voltage applying section for applying a voltage to the conveyance belt so that the conveyance belt electrostatically adsorbs the sheet.

7. The laser fusing apparatus according to claim 1, wherein the laser light source comprises a plurality of laser devices arranged in a widthwise direction of the sheet, the widthwise direction being perpendicular to a direction along which the sheet is conveyed.

8. The laser fusing apparatus according to claim 1, wherein the heat releasing portion is arranged to contact with the conveyance belt along a length of L that fulfills the following formula:

$$L \geq V \times 0.3$$

wherein L is a length in millimeter of the heat releasing portion in a direction along which the sheet is conveyed, and V is a velocity in millimeter/second at which the sheet is conveyed.

9. The laser fusing apparatus according to claim 1, wherein the fuser control section controls the laser light source so that the laser light source emits the laser beam when the sheet passes the irradiation region and does not emit the laser beam when the sheet is not in the irradiation region.

10. An image forming apparatus, comprising:

a laser fusing apparatus according to claim 1.

* * * * *